US005388552A

United States Patent [19]

Sugimoto et al.

[11] Patent Number: 5,388,552

[45] Date of Patent: Feb. 14, 1995

[54] VALVE OPERATING DEVICE FOR AN INTERNAL COMBUSTION ENGINE

[75] Inventors: Chihaya Sugimoto; Masakazu Kinoshita; Izumi Sugiyama; Hideki Saito; Shigemasa Kajiwara; Susumu Toki, all of Saitama, Japan

[73] Assignee: Honda Giken Kogyo Kabushiki Kaisha, Tokyo, Japan

[21] Appl. No.: 121,992

[22] Filed: Sep. 15, 1993

[30] Foreign Application Priority Data

Sep. 16, 1992 [JP] Japan ..... 4-246647
Sep. 16, 1992 [JP] Japan ..... 4-246648

[51] Int. Cl.[6] ..... F01L 1/34
[52] U.S. Cl. ..... 123/90.16
[58] Field of Search ..... 123/90.15, 90.16, 90.22, 123/90.39

[56] References Cited

U.S. PATENT DOCUMENTS

| | | | |
|---|---|---|---|
| 4,612,884 | 9/1986 | Ajiki et al. | 123/90.16 |
| 4,869,214 | 9/1989 | Inoue et al. | 123/90.16 |
| 4,887,563 | 12/1989 | Ishida et al. | 123/90.16 |
| 5,042,437 | 8/1991 | Sakuragi et al. | 123/90.16 |
| 5,085,182 | 2/1992 | Nakamura et al. | 123/90.16 |

FOREIGN PATENT DOCUMENTS

| | | | |
|---|---|---|---|
| 0265191 | 4/1988 | European Pat. Off. . | |
| 0267696 | 5/1988 | European Pat. Off. . | |
| 0276531 | 8/1988 | European Pat. Off. . | |
| 0391739 | 10/1990 | European Pat. Off. . | |
| 61-31611 | 2/1986 | Japan . | |
| 63-57805 | 3/1988 | Japan . | |
| 3210 | 1/1989 | Japan | 123/90.16 |
| 250286 | 11/1990 | Japan . | |
| 2199894 | 7/1988 | United Kingdom . | |

OTHER PUBLICATIONS

English language Abstract of JP 60-252112.

*Primary Examiner*—E. Rollins Cross
*Assistant Examiner*—Weilun Lo
*Attorney, Agent, or Firm*—Lyon & Lyon

[57] ABSTRACT

A valve operating mechanism for an internal combustion engine for varying the operation of the valve dependent on engine operating conditions. A first rocker arm movable to follow a first cam and a second rocker arm movable to follow a second cam corresponding to a higher speed operating condition than that of the first cam are pivotally supported on a rocker arm shaft. A first connection switching device capable of switching the connection and disconnection between the third and first rocker arms and a second switching device capable of switching the connection and disconnection between at least one of the first and third rocker arms and the second rocker arm independently from the first connection switching device, are disposed at locations displaced circumferentially relative to the rocker arm shaft. Thus, it is possible to dispose a trigger mechanism and to dispose roller followers coaxially with the connection switching device, while avoiding the increase in width of the three rocker arms along their swinging axes.

14 Claims, 13 Drawing Sheets

VALVE OPERATING DEVICE FOR AN INTERNAL COMBUSTION ENGINE

BACKGROUND OF THE INVENTION

1. Field of the Invention

The present invention relates to a valve operating device for use in an internal combustion engine for varying operating characteristics of an engine valve depending on an operating condition of the engine.

2. Description of the Prior Art

One conventional valve operating device is known from Japanese Patent Application Laid-open No. 57805/88, for example.

In the valve operating device disclosed in the above patent application, three rocker arms are disposed in an adjacent arrangement, and the adjacent rocker arms in two sets are connected to and disconnected from each other. This allows a pair of engine valves connected to the outer rocker arms to be varied in their operating characteristics depending upon three operating conditions: a low-speed operating condition, a medium-speed operating condition and a high-speed operating condition of the engine. In the prior art device, however, a selective coupling means for connecting the adjacent rocker arms in one of the sets to each other and a selective coupling means for connecting the adjacent rocker arms in the other set to each other are disposed coaxially and hence, in order to insure an operational stroke of each selective coupling means, the width of the three adjacent rocker arms along their swinging axes must be set larger. Therefore, the valve-operating device has an increased size, and in order to insure the rigidity at the time when the rocker arms are connected, it is necessary to increase the strength of the rocker arms.

There is also a conventionally known valve operating device including a trigger mechanism mounted to the selective coupling means for restraining the operational timing for the selective coupling means, as disclosed in Japanese Patent Application Laid-open No. 31611/86. If the trigger mechanism is applied to a valve operating device of the conventional type described above, which includes a pair of selective coupling means disposed coaxially, however, the axial length of a connecting piston as a component of the selective coupling means should be set relatively long. For this reason, the width of the rocker arms along their swinging axes must be further increased. Further, there is a conventionally known valve operating device which includes rocker arms each movable to follow a cam through a roller follower in order to reduce the resistance of friction with the cam, and selective coupling means disposed coaxially with the roller follower, as disclosed in Japanese Patent Publication No. 50286/90. In such a conventional valve operating device including a pair of the selective coupling means disposed coaxially, however, if the means are disposed coaxially with the roller followers, the width of the rocker arms must be further increased in order to insure a space occupied by the roller followers.

On the other hand, in the valve operating device disclosed in the above Japanese Patent Application Laid-open No. 57805/88, the operating characteristics of each of the engine valves is varied at two stages of a disconnection condition in which the engine valve is opened and closed in accordance to the operation of the rocker arm connected to the engine valve, and a connection condition in which the engine valve is opened and closed in accordance to the operation of the adjacent rocker arm. Therefore, in order to achieve the variation of the operating characteristics at three stages according to the operating conditions of the engine, a combination of these stages must be selected from a limited combination of connection and disconnection of two sets of rocker arms. In order to enable a more precise varying control of valve-operating characteristics according to the operating conditions of the engine, it is desirable to increase the freedom of selection of a combination of the valve-operating characteristics in each operating region.

SUMMARY OF THE INVENTION

Accordingly, it is a first object of the present invention to provide a valve operating device for an internal combustion engine, wherein a trigger mechanism can be disposed, and a roller follower can be disposed coaxially with a selective coupling means, while avoiding an increase in width of three rocker arms along their swinging axes.

To achieve the above object, according to a first aspect and feature of the present invention, there is provided a valve operating device for use in an internal combustion engine for varying operating characteristics of an engine valve depending upon operating conditions of the engine, comprising a first rocker arm movable in response to a first cam, a second rocker arm movable in response to a second cam corresponding to a higher speed operating condition than that of the first cam, a third rocker arm operatively connected to an engine valve, the first, second and third rocker arms being pivotally supported on a rocker arm shaft, first selective coupling means capable of switching the connection and disconnection between the third and first rocker arms, and second selective coupling means capable of switching the connection and disconnection between the second rocker arm and at least one of the first and third rocker arms independently of the first selective coupling means, the first and second selective coupling means being disposed at locations displaced circumferentially relative to the rocker arm shaft.

With the above construction, it is possible to sufficiently insure an operational stroke of each selective coupling means, while the width of each rocker arm along its swinging axis remains set relatively small. Moreover, it is possible to dispose a trigger mechanism and to dispose the selective coupling means coaxially with roller followers, while such width remains set relatively small, thereby providing a reduction in size of the valve operating device and sufficiently insuring a rigidity at the time when the rocker arms are connected.

In addition to the first feature of the present invention, if at least one of the first and second selective coupling means exhibits a spring force in an expanding direction thereof for expanding and contracting, and includes a connection piston operable in a direction parallel to an axis of the rocker arm shaft; and wherein the device further includes a trigger which is disposed for angular displacement relative to the rocker arms and is brought into detachable engagement with the connecting piston for restraining the operational timing, it is possible to provide a precise operational timing for the selective coupling means, thereby insuring a reliable operation thereof.

Further, in addition to the first feature of the invention, if the valve operating device further includes a third cam provided to correspond to the third rocker arm, and roller followers provided on the first, second and third rocker arms to come into contact with the first, second and third cams, respectively; and wherein either one of the first and second selective coupling means is disposed coaxially with the roller followers, it is possible to reduce the friction loss and to reduce the force for operating the valve, while avoiding the increase in size of the rocker arms.

It is a second object of the invention to provide a valve operating device for an internal combustion engine, wherein it is possible to increase the freedom of selection of the characteristics of operation of engine valves by the three rocker arms depending upon the operating conditions of the engine, and avoid the increase in width of the three rocker arms along their swinging axes.

To achieve the above second object, according to the present invention, there is provided a valve operating device for use in an internal combustion engine for varying operating characteristics of an engine valve depending upon operating conditions of the engine, comprising a first rocker arm movable in response to a first cam, a second rocker arm movable in response to a second cam corresponding to a higher speed operating condition than that of the first cam, a third rocker arm operatively connected to an engine valve, the first and second rocker arms being disposed on one side of the third rocker arm, first selective coupling means mounted astride the rocker arm adjacent the third rocker arm and between the third rocker arm and one of the first and second rocker arms which is remotest from the third rocker arm for switching the connection and disconnection between the third rocker arm and the one of the first and second rocker arm, and second selective coupling means mounted between at least two mutually adjacent ones of first through third rocker arms for switching the connection and disconnection between the adjacent rocker arm independently of the first selective coupling means.

With the above construction, it is possible to vary the operating characteristics of an engine valve operatively connected to the third rocker arm at three stages; to increase the freedom of selection of the operating characteristics of the engine valve; to reduce the width in each rocker arm along its swinging axis by offsetting both the connection switching means around each rocker arm, and to increase the rigidity at the time when the rocker arms are connected.

In addition to the construction according to the second feature of the invention, if an engine valve other than the engine valve operatively connected to the third rocker arm is operatively connected to the first rocker arm, and wherein the second rocker arm is disposed between the first and third rocker arms, the driving load from the cams during operation of the engine at a high-speed can be applied to both the engine valves in a substantially equally distributed manner, thereby preventing an offset load from being generated.

The above and other objects, features and advantages of the invention will become apparent from the following description of preferred embodiments, taken in conjunction with the accompanying drawings.

DESCRIPTION OF THE PREFERRED EMBODIMENTS

Embodiments of the present invention will hereinafter be described with reference to the drawings.

Figure 1:
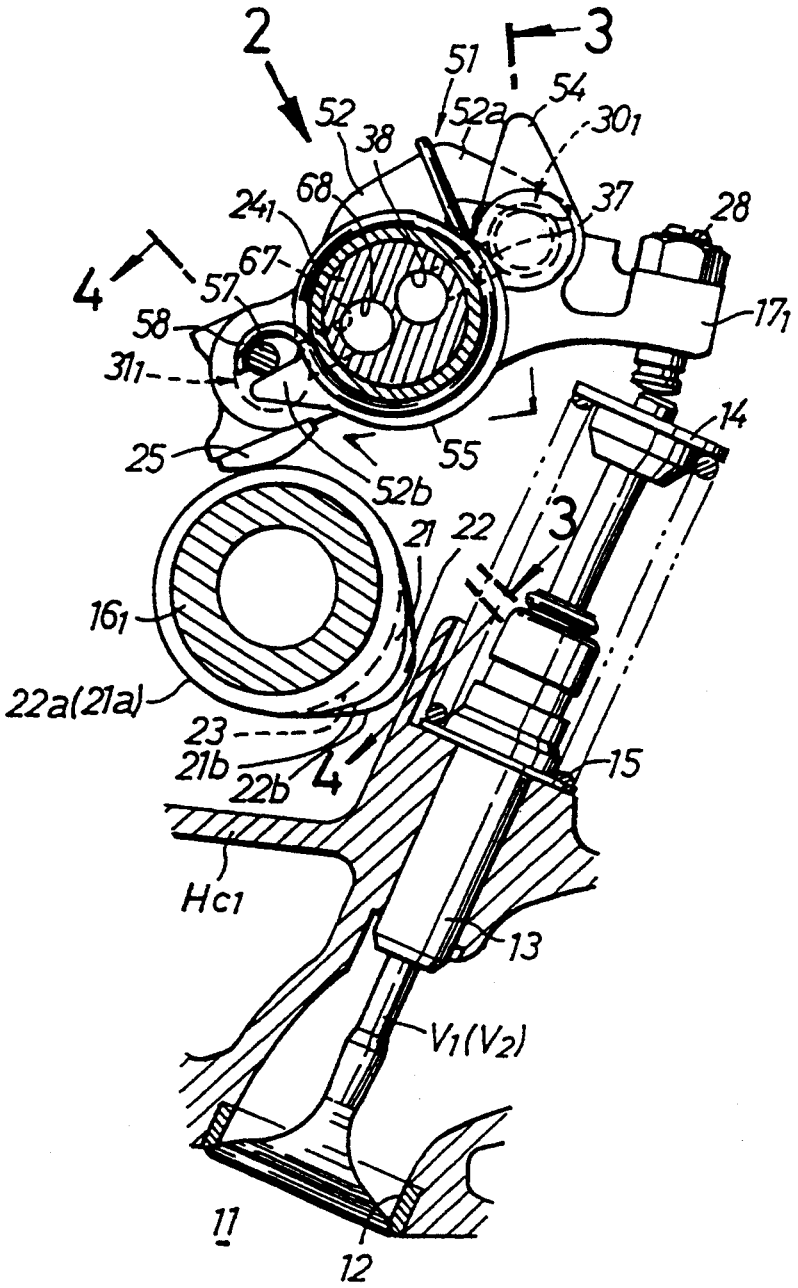
FIG. 1 is a longitudinal sectional view, taken along a line 1—1 in FIG. 2, of a first embodiment of the present invention when being applied to an intake valve-side valve operating device in an SOHC internal combustion engine.
Figure 2:
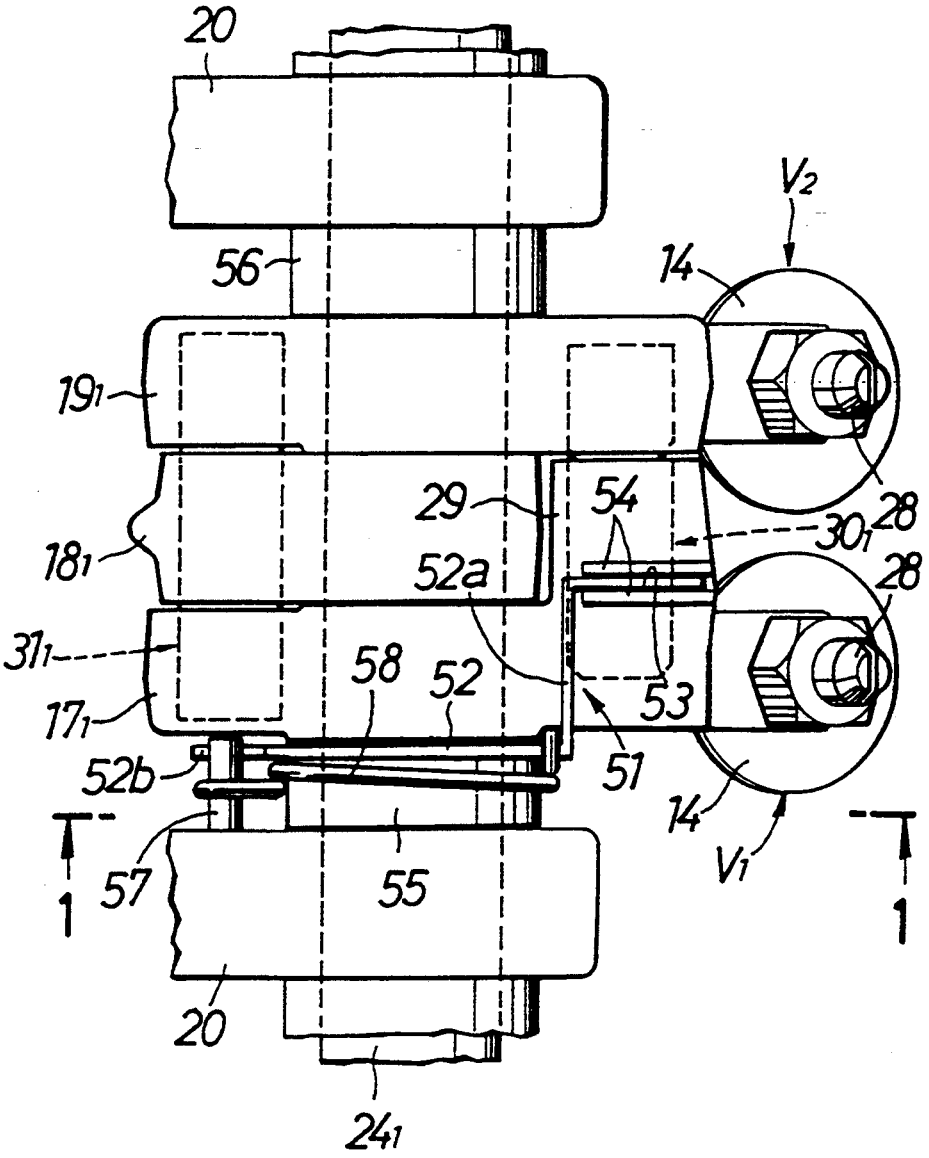
FIG. 2 is an enlarged plan view taken along an arrow 2 in FIG. 1.

FIGS. 1 to 4 show a first embodiment of the invention. As shown in FIGS. 1 and 2, a cylinder head Hc1 of an SOHC internal combustion engine has a pair of intake ports 12 opening at an upper surface of a combustion chamber 11. A pair of engine valves or intake valves $V_1$, $V_2$ for opening and closing the intake ports 12 individually is slidably fitted in a pair of respective guide sleeves 13 mounted in the cylinder head Hc1. The intake valves $V_1$, $V_2$ have respective upper ends projecting from the respective guide sleeves 13. The intake valves $V_1$, $V_2$ are normally urged upwardly, i.e., in a valve closing direction, by coil valve springs 15 disposed around the intake valves $V_1$, $V_2$ between retainers 14 fixed to the projecting upper ends of the intake valves $V_1$, $V_2$ and the cylinder head Hc1.

A cam shaft $\mathbf{16_1}$ that is shared by the intake valves $V_1$, $V_2$ and exhaust valves (not shown) is operatively coupled to a crankshaft (not shown) for rotation at a speed reduction ratio of ½ with respect to the rotation of the crankshaft. First, second, and third rocker arms $\mathbf{17_1}$, $\mathbf{18_1}$, $\mathbf{19_1}$ are interposed between the cam shaft $\mathbf{16_1}$ and the intake valves $V_1$, $V_2$ for converting rotary movement of the cam shaft $\mathbf{16_1}$ to opening and closing movement of the intake valves $V_1$, $V_2$.

Figure 3:
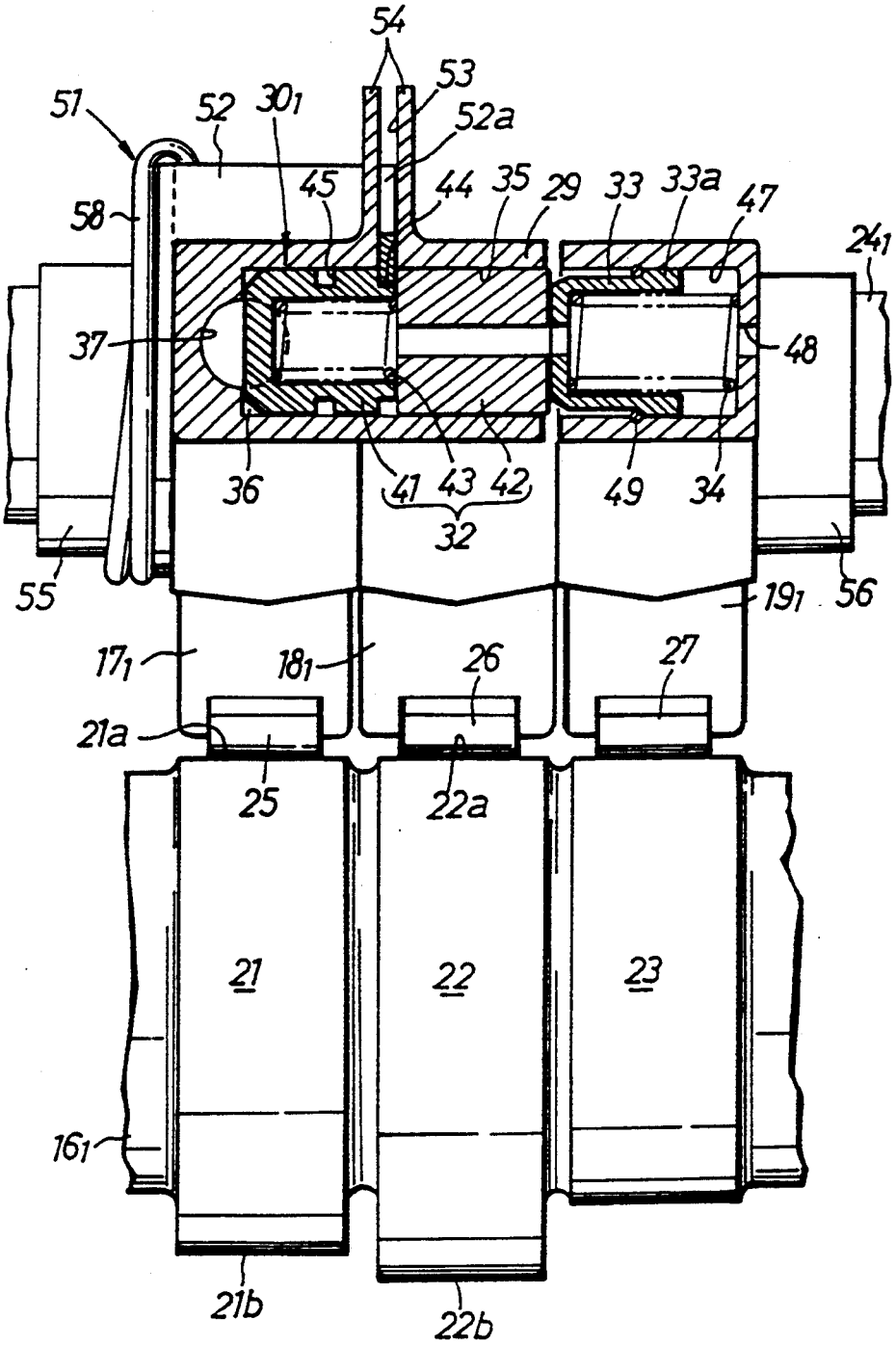
FIG. 3 is an enlarged sectional view taken along a line 3—3 in FIG. 1.

As also shown in FIG. 3, the cam shaft $16_1$ is rotatably supported by the cylinder head Hc1 and a plurality of holders 20 coupled to the cylinder head Hc1. The cam shaft $16_1$ has a low-speed cam 21, a high-speed cam 22, and a raised portion 23 which are integrally formed with the cam shaft $16_1$ and successively arranged in the order named. The low-speed cam 21 has a cam profile for opening and closing the intake valve $V_1$ in a low-speed operating range of the engine and opening and closing the intake valves $V_1$, $V_2$ in a medium-speed operating range of the engine. The low-speed cam 21 comprises a base-circle portion 21*a* and a cam lobe 21*b* projecting radially outwardly from the base-circle portion 21*a*. The high-speed cam 22 has a cam profile for opening and closing the intake valves $V_1$, $V_2$ in a high-speed operating range of the engine. The high-speed cam 22 comprises a base-circle portion 22*a* and a cam lobe 22*b* projecting more radially outwardly from the base-circle portion 22*a* than the cam lobe 21*b* of the low-speed cam 21 and having a larger angular extent than the cam lobe 21*b*. The raised portion 23 has a substantially circular profile around the axis of the cam shaft $16_1$ for substantially disabling the intake valve $V_2$ in a low-speed operating range of the engine. The raised portion 23 includes a slightly radially projecting region in a position corresponding to the cam lobes 21*b*, 22*b* of the low- and high-speed cams 21, 22.

The first rocker arm $17_1$ is operatively coupled to the intake valve $V_1$, and the third rocker arm $19_1$ is operatively coupled to the intake valve $V_1$. The second rocker arm $18_1$ is disposed between the first and third rocker arms $17_1$, $19_1$ adjacent thereto so that the second rocker arm $18_1$ can be freed from the intake valves $V_1$, $V_2$. The rocker arms $17_1$ to $19_1$ are rockably supported on a rocker arm shaft $24_1$ positioned obliquely upwardly of the cam shaft $16_1$, and having an axis parallel to the cam shaft $16_1$, the rocker arm shaft $24_1$ being fixedly supported by the holders 20.

A cam slipper 25 held in sliding contact with the low-speed cam 21 is mounted on a lower portion of the lower end of the first rocker arm $17_1$. A cam slipper 26 held in sliding contact with the high-speed cam 22 is mounted on the lower surface of a lower portion of the second rocker arm $18_1$. A slipper 27 held in sliding contact with the raised portion 23 is mounted on a lower portion of the lower end of the third arm $19_1$.

Tappet screws 28 are axially movable threaded in the respective other ends of the first and third rocker arms $17_1$, $19_1$, and held in abutment against the upper ends of the intake valves $V_1$, $V_2$. Therefore, the intake valves $V_1$, $V_2$ are opened and closed in response to rocking movement of the first and third rocker arms $17_1$, $19_1$.

The second rocker arm $18_1$ is resiliently urged in a direction to hold the cam slipper 26 in sliding contact with the high-speed cam 22 by a resiliently urging means (not shown).

The first selective coupling means $30_1$ is disposed between the first and third rocker arms $17_1$, $19_1$ for selectively connecting and disconnecting the first and third rocker arms $17_1$, $19_1$. A second selective coupling means $31_1$ is disposed in the first through third rocker arms $17_1$ to $19_1$ at a position different from the first selective coupling means $30_1$ around the axis of the rocker arm shaft $24_1$ for selectively connecting and disconnecting the first through third rocker arms $17_1$ to $19_1$ independently of the first selective coupling means $30_1$.

The first rocker arm $17_1$ has an integral joint arm 29 positioned more closely than the rocker arm shaft $24_1$ to the intake valves $V_1$, $V_2$ and extending across the second rocker arm $18_1$ toward the third rocker arm $19_1$. The first selective coupling means $30_1$ is arranged to selectively connect and disconnect the joint arm 29 and the third rocker arm $19_1$. The second selective coupling means $31_1$ is provided in the first through third rocker arms $17_1$ to $19_1$ diametrically opposite to the first selective coupling means $30_1$ across the rocker arm shaft $24_1$.

The first selective coupling means $30_1$ comprises a coupling piston 32 capable of connecting the first and third rocker arms $17_1$, $19_1$ to each other, a limiting member 33 for limiting movement of the coupling piston 32, and a return spring 34 for urging the coupling piston 32 and the limiting member 33 in a direction to disconnect the first and third rocker arms $17_1$, $19_1$ from each other.

The joint arm 29 of the first rocker arm $17_1$ has a bottomed guide hole 35 defined therein parallel to the rocker arm shaft $24_1$ and opening toward the third rocker arm $19_1$. The coupling piston 32 is slidably fitted in the guide hole 35. A hydraulic pressure chamber 36 is defined between one end of the coupling piston 32 and the closed end of the guide hole 35. The first rocker arm $17_1$ has a communication passage 37 communicating with the hydraulic pressure chamber 36. Within the rocker arm shaft $24_1$ is provided a hydraulic pressure passage 38 connected to a hydraulic pressure supply source, not shown. The hydraulic pressure passage 38 is held in communication with the communication passage 37 and hence the hydraulic pressure chamber 36 irrespective of how the first rocker arm $17_1$ may be angularly moved.

The coupling piston 32 is extensible and contractible while under a spring force from spring 43 tending to extend the coupling piston 32. The coupling piston 32 comprises a bottomed hollow cylindrical body 41 slidably fitted in the guide hole 35 and having a closed end facing the hydraulic pressure chamber 36, a short cylindrical body 42 slidably fitted in the guide hole 35, and a spring 43 compressed between the bottomed cylindrical body 41 and the short cylindrical body 42. The bottomed cylindrical body 41 has an annular recess defined in an outer surface of the open end thereof and defining a first annular engaging groove 44 between the bottomed cylindrical body 41 and one end of the short cylindrical body 42 when the open end of the bottomed cylindrical body 41 abuts against the end of the short cylindrical body 42. The bottomed cylindrical body 41 also has a second annular engaging groove 45 defined in an outer circumferential surface thereof. The set load of the spring 43 is smaller than that of the return spring 34.

The third rocker arm $19_1$ has a bottomed guide hole 47 corresponding to the guide hole 35. The bottomed guide hole 47 opens toward the joint arm 29 and extends parallel to the rocker arm shaft $24_1$. The limiting member 33, which is in the form of a bottomed cylinder, is slidably fitted in the guide hole 47 and held in abutment against the other end of the short cylindrical body 42 of the coupling piston 32. The limiting member 33 has an open end facing toward the closed end of the guide hole 47 and a radially outwardly projecting flange 33*a* held in sliding contact with an inner surface of the guide hole 47. The return spring 34 is compressed between the closed end of the guide hole 47 and the closed end of the limiting member 33 for urging the coupling piston 32 and the limiting member 33 which are mutually abutted against each other toward the hydraulic pressure chamber 36. The closed end of the guide hole 47 has a communication hole 48 for bleeding air and oil. A retaining ring 49 is fitted in the inner surface of the guide hole 47 for engaging the flange 33*a* of the limiting member 33 to prevent the limiting member 33 from being dislodged out of the guide hole 47.

The first selective coupling means $30_1$ is provided with a trigger mechanism 51 for controlling the timing for the first selective coupling means $30_1$ to be operated. The trigger mechanism 51 has a trigger plate 52 swingable relatively to the rocker arms $17_1$ to $19_1$ about the axis of the rocker arm shaft $24_1$ between a position in which the trigger plate 52 engages in the first engaging groove 44 or the second engaging groove 45 of the coupling piston 32 to limit movement of the coupling piston 32, and a position in which the trigger plate 52 disengages from the first engaging groove 44 or the second engaging groove 45 to allow movement of the coupling piston 32.

The first rocker arm $17_1$ has a slit 53 defined in an upper portion thereof and a pair of guide plates 54 extending upwardly with one on each side of the slit 53. The slit 53 is positioned to align with the first engaging groove 44 when the bottomed cylindrical body 41 and the short cylindrical body 42 are displaced a maximum stroke toward the hydraulic pressure chamber 36, as shown in FIG. 3. When the bottomed cylindrical body 41 and the short cylindrical body 42 that abut against each other are moved a maximum stroke away from the hydraulic pressure chamber 36, the second engaging groove 45 is positioned in alignment with the slit 53.

A cylindrical collar 55 is fitted over the rocker arm shaft $24_1$ between the first rocker arm $17_1$ and one of the holders 20, and a cylindrical collar 56 is fitted over the rocker arm shaft $24_1$ between the other holder 20 and the third rocker arm $19_1$. These collars 55, 56 prevent the rocker arms $17_1$ to $19_1$ from moving along the rocker arm shaft $24_1$.

The trigger plate 52 is supported on the collar 55 for angular movement relatively thereto. The trigger plate 52 has an integral engaging plate 52*a* whose opposite surfaces are held in sliding contact with the guide plates 54, respectively, and which extends from the slit 53 into releasable engagement in the first engaging groove 44 or the second engaging groove 45.

The holder 20 which confronts the first rocker arm $17_1$ has a stopper pin 57 extending toward the first rocker arm $17_1$. A stopper 52*b* engageable upwardly with the stopper pin 57 projects from the trigger plate 52. A torsion spring 58 disposed around the collar 55 has one end engaging the stopper pin 57 and the other end engaging the trigger plate 52 downwardly. The trigger plate 52 is normally urged by the torsion spring 58 in a direction to cause the stopper 52*b* to abut against the stopper pin 57. The stopper pin 57 is positioned such that with the stopper 52*b* abutting against the stopper pin 57, when the first rocker arm $17_1$ is at rest, the engaging plate 52*a* can extend from the slit 53 into engagement in the engaging grooves 54, 55, and when the first rocker arm $17_1$ is angularly moved in a valve opening direction, the engaging plate 52 is released from the slit 53.

Figure 4:
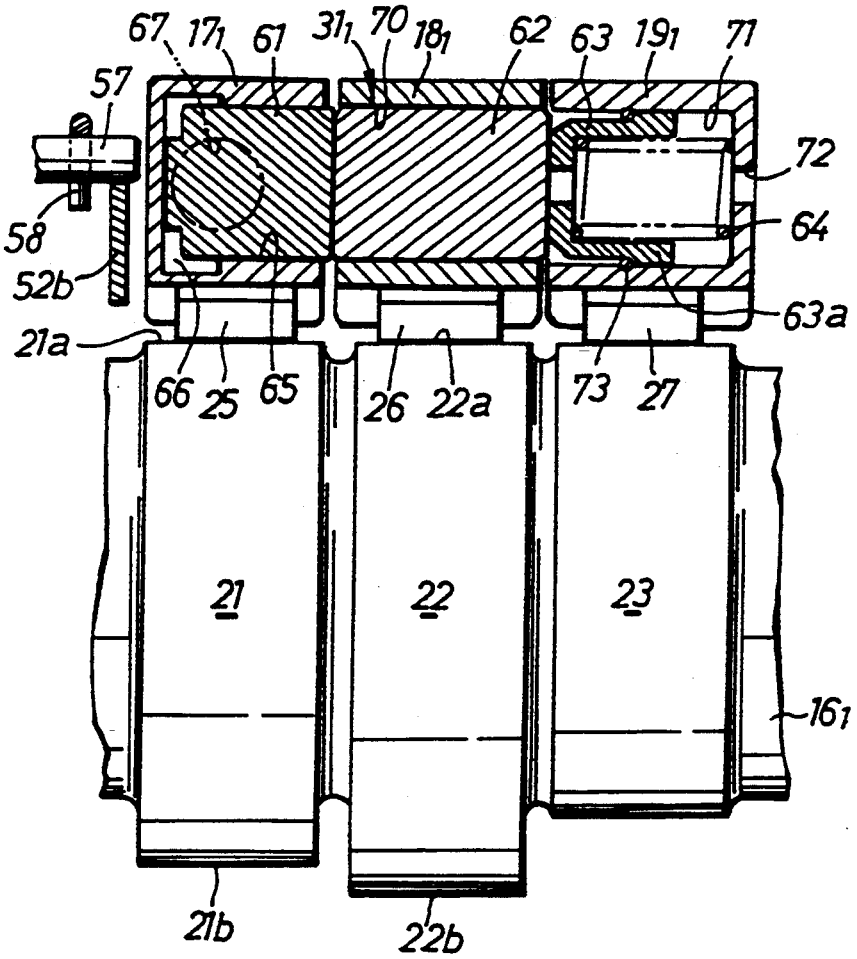
FIG. 4 is an enlarged sectional view taken along a line 4—4 in FIG. 1.

As shown in FIG. 4, the second selective coupling means $31_1$ comprises a coupling piston 61 capable of connecting the first and second rocker arms $17_1$, $18_1$ to each other, a coupling pin 62 capable of connecting the second and third rocker arms $18_1$, $19_1$ to each other, a limiting member 63 for limiting movement of the coupling piston 61 and the coupling pin 62, and a return spring 64 for urging the coupling piston 61, the coupling pin 62, and the limiting member 63 in a direction to disconnect the first, second, and third rocker arms $17_1$, $18_1$, $19_1$ from each other.

The first rocker arm $17_1$ has a bottomed guide hole 65 defined therein parallel to the rocker arm shaft $24_1$ and opening toward the second rocker arm $18_1$. The coupling piston 61 is slidably fitted in the guide hole 65. A hydraulic pressure chamber 66 is defined between one end of the coupling piston 61 and the closed end of the guide hole 65. The first rocker arm $17_1$ has a communication passage 67 communicating with the hydraulic pressure chamber 66. The rocker arm shaft $24_1$ has a hydraulic pressure passage 68 connected to the hydraulic pressure supply source (not shown) and isolated from the hydraulic passage 38 of the first selective coupling means $30_1$. The hydraulic pressure passage 68 is always communicated with the communication passage 67 and hence the hydraulic pressure chamber 66 irrespective of how the first rocker arm $17_1$ is angularly moved.

The second rocker arm $18_1$ has a guide hole 70 corresponding to the guide hole 65 and extending between its opposite sides parallel to the rocker arm shaft $24_1$. The coupling pin 62 having one end abutting against the other end of the coupling piston 61 is slidably fitted in the guide hole 70.

The third rocker arm $19_1$ has a bottomed guide hole 71 corresponding to the guide hole 70. The bottomed guide hole 71 opens toward the second rocker arm $18_1$ and extends parallel to the rocker arm shaft $24_1$. The limiting member 63, which is in the form of a bottomed cylinder, is slidably fitted in the guide hole 71 and held in abutment against the other end of the coupling pin 62. The limiting member 63 has an open end facing toward the closed end of the guide hole 71 and a radially outwardly projecting flange 63*a* held in sliding contact with an inner surface of the guide hole 71. The return spring 64 is compressed between the closed end of the guide hole 71 and the closed end of the limiting member 63 for urging the mutually abutted coupling piston 61, the coupling pin 62, and the limiting member 63 toward the hydraulic pressure chamber 66. The closed end of the guide hole 71 has a communication hole 72 for bleeding air and oil. A retaining ring 73 is fitted in the inner surface of the guide hole 71 for engaging the flange 63*a* of the limiting member 63 to prevent the latter from being dislodged out of the guide hole 71.

Operation of the first embodiment will be described below. In the low-speed operating range of the engine, no hydraulic pressure is developed in the hydraulic chambers 36, 66 of the first and second selective coupling means $30_1$, $31_1$. In the first selective coupling means $30_1$, the coupling piston 32 is moved a maximum stroke toward the hydraulic pressure chamber 36 under the force of the return spring 34, disconnecting the first and third rocker arms $17_1$, $19_1$ from each other. In the second selective coupling means $31_1$, the coupling piston 61 and the coupling pin 62 are moved a maximum stroke toward the hydraulic pressure chamber 66 under the force of the return spring 64, disconnecting the first, second and third rocker arms $17_1$, $18_1$, $19_1$ from each other. At this time, in the first selective coupling means $30_1$, the trigger plate 52 engages in the first engaging groove 44 with the first rocker arm $17_1$ at rest. And the mutually abutting surfaces of the coupling piston 32 and the limiting member 33 are positioned between the joint arm 29 integral with the first rocker arm $17_1$ and the third rocker arm $19_1$. In the second selective coupling means $31_1$, the mutually abutting surfaces of the coupling piston 61 and the coupling pin 62 are positioned between the first and second rocker arms $17_1$, $18_1$, and the mutually abutting surfaces of the coupling pin 62 and the limiting member 63 are positioned between the second and third rocker arms $18_1$, $19_1$. Consequently, the first, second, and third rocker arms $17_1$, $18_1$, $19_1$ are angularly displaceable with respect to each other.

While the first and second coupling means $30_1$, $31_1$ are thus in a position to disconnect the rocker arms, rotation of the cam shaft $16_1$ causes the first rocker arm $17_1$ to swing based on sliding contact with the low-speed cam 21, and the intake valve $V_1$ is opened and closed with timing and lift according to the cam profile of the low-speed cam 21. The third rocker arm $19_1$ held in sliding contact with the raised portion 23 substantially stops its swinging movement, thereby substantially keeping the other intake valve $V_2$ closed. However, since the raised portion 23 has a slightly projecting region at a position corresponding to the cam lobes **21*b*, 22*b* of the low- and high-speed cams 21, 22, the intake valve $V_2$ is not completely closed, but is slightly opened when the intake valve $V_1$ is opened. Therefore, the intake valve $V_2$ is prevented from sticking to its valve seat. The second rocker arm $18_1$ swings based on sliding contact with the high-speed cam 22**. However, the swinging movement of the second rocker arm $18_1$ does not affect the first and third rocker arms $17_1$, $19_1$.

In the medium-speed operating range of the engine, the second selective coupling means $31_1$ is in a position to disconnect the rocker arms as no hydraulic pressure is built up in the hydraulic pressure chamber 66, and the hydraulic pressure chamber 36 of the first selective coupling means $30_1$ is supplied with a high hydraulic pressure. The coupling piston 32 of the first selective coupling means $30_1$ tends to move in a direction to increase the displacement of the hydraulic pressure chamber 36 against the bias of the return spring 34. When the first rocker arm $17_1$ is at rest, however, the coupling piston 32 is prevented from moving as the trigger plate 52 engages in the first engaging groove 44. When the first rocker arm $17_1$ starts moving in a valve opening direction, the engaging plate **52*b* of the trigger plate 52 disengages from the first engaging groove 44, allowing the coupling piston 32 to move. The coupling piston 32 slightly moves toward the third rocker arm $19_1$, shifting the first engaging groove 44 out of alignment with the slit 53. Therefore, the trigger plate 52 does not engage in the first engaging groove 44** after the first rocker arm $17_1$ starts moving in the valve opening direction.

When the axes of the guide holes 35, 47 are aligned with each other, i.e., when the rocker arms $17_1$ to $19_1$ return to an at rest position, the coupling piston 32 fits into the guide hole 47, connecting the first and third rocker arms $17_1$, $19_1$ to each other. In this condition, the second engaging groove 45 is aligned with the slit 53. When the first rocker arm $17_1$ is held at rest, the trigger plate 52 engages in the second engaging groove 45.

With the first and third rocker arms $17_1$, $19_1$ connected to each other, the third rocker arm $19_1$ swings with the first rocker arm $17_1$ that is held in sliding contact with the low-speed cam 21. Consequently, the intake valves $V_1$, $V_2$ are opened and closed with timing and lift according to the cam profile of the low-speed cam 21.

In the high-speed operating range of the engine, a high hydraulic pressure is introduced into both the hydraulic pressure chambers 36, 66 of the first and second selective coupling means $30_1$, $31_1$. The first selective coupling means $30_1$ continues to keep the rocker arms connected. The hydraulic pressure developed in the hydraulic pressure chamber 66 of the second selective coupling means $31_1$ pushes the coupling piston 61 against a force of the return spring 64. When the axes of the guide holes 65, 70, 71 are aligned with each other, the coupling piston 61 fits into the guide hole 70 and the coupling pin 62 fits into the guide hole 71, thereby connecting the first, second and third rocker arms $17_1$ to $19_1$ to each other.

When the first to third rocker arms $17_1$ to $19_1$ are connected to each other, the first and third rocker arms that are operatively coupled to the intake valves $V_1$, $V_2$ swing with the second rocker arm $18_1$ that is angularly moved by the high-speed cam 22. The intake valves are therefore opened and closed with timing and lift according to the cam profile of the high-speed cam 22.

After the rocker arms have been connected by the second selective coupling means $31_1$in the high-speed operating range of the engine, the hydraulic pressure may be released from the hydraulic pressure chamber 36 of the first selective coupling means $30_1$ to cause the first selective coupling means $30_1$ to disconnect the rocker arms.

When the engine switches from the high-speed operating range to the low-speed operating range, or when the hydraulic pressure is released from the hydraulic pressure chamber 36 of the first selective coupling means $30_1$ after the rocker arms have been connected by the second selective coupling means $31_1$ in the high-speed operating range of the engine, the coupling piston 32 is pushed toward the hydraulic pressure chamber 36 under the resiliency of the return spring 34. When the first rocker arms $17_1$ is at rest, the trigger plate 52 engages in the second engaging groove 45, and hence the coupling piston 32 is prevented from moving. When the first rocker arm $17_1$ starts to move in the valve opening direction, the trigger plate 52 disengages from the second engaging groove 45, and the bottomed cylindrical body 41 first moves toward the hydraulic pressure chamber 36 under the bias of the return spring 43. At this time, the short cylindrical body 42 does not return to the guide hole 35 due to frictional forces produced in the guide holes 35, 47 upon rocking movement of the first rocker arm $17_1$. When the first rocker arm $17_1$ is then returned to an at rest position, the short cylindrical body 42 returns to the guide hole 35, disconnecting the first and third rocker arms $17_1$, $19_1$. In the second selective coupling means $31_1$, when the axes of the guide hole 65, the guide hole 70, and the guide hole 71 are aligned with each other, the coupling piston 61 returns to the guide hole 65, and the coupling pin 62 returns to the guide hole 70, disconnecting the rocker arms.

Consequently, in the low-speed operating range of the engine, the intake valve $V_1$ is opened and closed with timing and lift according to the cam profile of the low-speed cam 21, and the other intake valve $V_2$ is substantially disabled for reducing fuel consumption. In the medium-speed operating range of the engine, the intake valves $V_1$, $V_2$ are opened and closed with timing and lift according to the cam profile of the low-speed cam 21 for producing an output torque matching the medium-speed operating range. In the high-speed operating range of the engine, the intake valves $V_1$, $V_2$ are opened and closed with timing and lift according to the cam profile of the high-speed cam 22 for increasing the engine output power. Accordingly, the valve operating device can provide valve operating characteristics depending respectively on the low-, medium- and high-speed operating ranges of the engine.

The intake valve $V_2$ operatively coupled to the third rocker arm $19_1$ can be operatively coupled to the first rocker arm $17_1$ across the second rocker arm $18_1$. The intake valve $V_2$ is substantially disabled in the low-speed operating range of the engine, opened and closed by the low-speed cam 21 in the medium-speed operating range of the engine, and opened and closed by the high-speed cam 22 in the high-speed operating range of the engine. The intake valve $V_2$ is therefore capable of varying its operating characteristics in three steps. This, together with the fact that the intake valve $V_1$ operatively coupled to the first rocker arm $17_1$ can vary its operating characteristics in two steps, i.e., is opened and closed by the low-speed cam 21 and opened and closed by the high-speed cam 22, permit the operating characteristics of the intake valves $V_1$, $V_2$ which are variable depending on the operating conditions of the engine to be selected in combinations more freely than heretofore.

In this valve operating device, inasmuch as the second rocker arm $18_1$ slidingly contacting the high-speed cam 22 is disposed between the first and third rocker arms $17_1$, $19_1$ that are operatively coupled individually to the intake valves $V_1$, $V_2$, the drive load from the high-speed cam 22 can substantially uniformly be distributed to the intake valves $V_1$, $V_2$, which are thus prevented from suffering irregular loads.

The coupling piston 32 of the first selective coupling means $30_1$ is relatively long in its axial direction because it is composed of the bottomed cylindrical body 41 facing the hydraulic pressure chamber 36, the short cylindrical body 42, and the spring 43 compressed between the bottomed cylindrical body 41 and the short cylindrical body 42 for extension and traction under the spring force tending to extend the coupling piston 32 in order to disengageably engage the trigger plate 52 of the trigger mechanism 51. The first and second selective coupling means $30_1$, $31_1$ are displaced relative to each other around the axis of the rocker arm shaft $24_1$, and the first selective coupling means $30_1$ is disposed between the third rocker arm $19_1$ and the joint arm 29 extending from the first rocker arm $17_1$ toward the third rocker arm $19_1$. Therefore, the required length of the coupling piston 32 can be accommodated in the first rocker arm $17_1$ without increasing the width of the latter along the axis of the rocker arm shaft $24_1$, and the first selective coupling means $30_1$ can be actuated with proper timing by the trigger mechanism 51. A sufficient operating stroke is available for the first and second selective coupling means $30_1$, $31_1$ without increasing the width of the rocker arms $17_1$, $18_1$, $19_1$.

Figure 5:
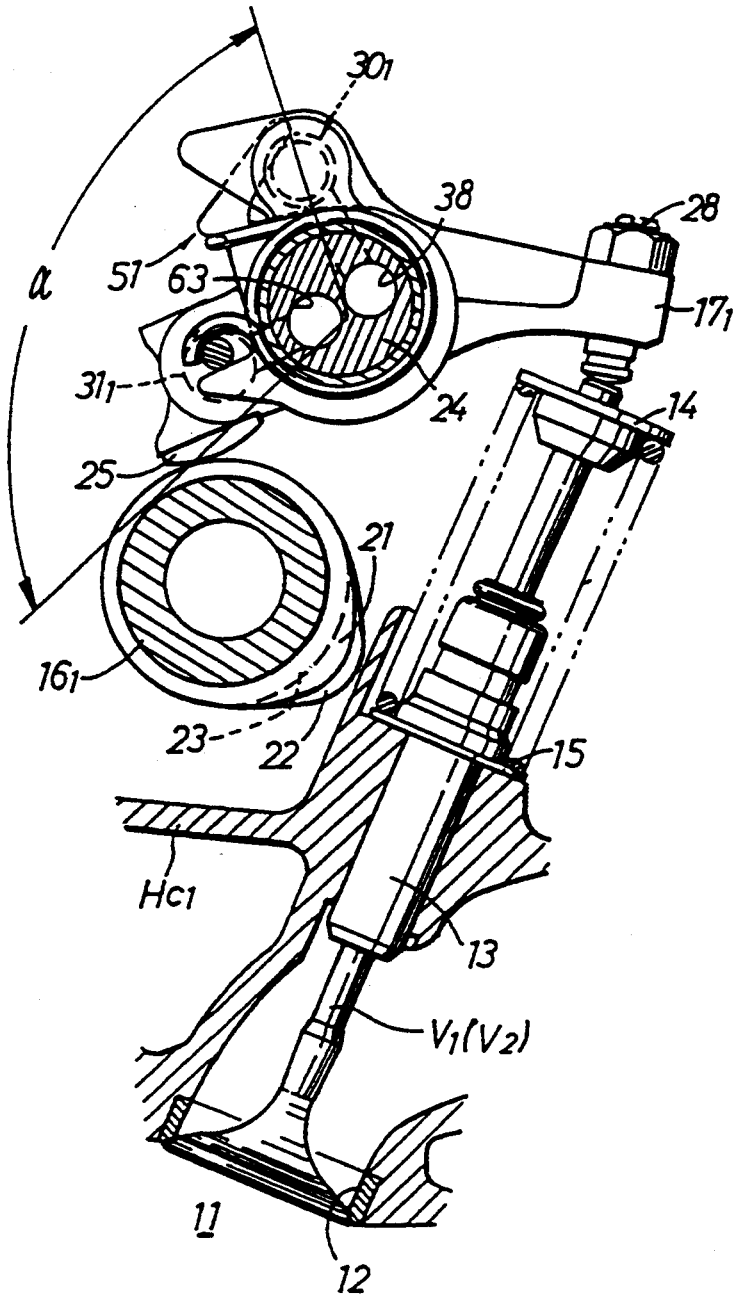
FIG. 5 is a longitudinal sectional view similar to FIG. 1, but illustrating a modification to the first embodiment.

FIG. 5 shows a modification of the first embodiment. The first selective coupling means $30_1$ that is operable independently of the second selective coupling means $31_1$ is disposed between the first and third rocker arms $17_1$, $19_1$ in a position such that the central angle $\alpha$ formed between the first selective coupling means $30_1$ and the point where the load is applied from the low-speed cam 21 to the first rocker arm $17_1$ is approximately 90°.

When the first selective coupling means $30_1$ is actuated to connect the rocker arms, since the third rocker arm $19_1$ is angularly moved by the first rocker arm $17_1$, the first rocker arm $17_1$ undergoes a rotational moment acting about a straight line that interconnects the junction between the first and third rocker arms $17_1$, $19_1$ perpendicular to the axis of the rocker arm shaft $24_1$. However, inasmuch as the first selective coupling means $30_1$ is disposed in a position such that the central angle $\alpha$ formed between the first selective coupling means $30_1$ and the point where the load is applied from the low-speed cam 21 to the first rocker arm $17_1$ is approximately 90°, the above rotational moment is produced in a plane substantially parallel to the slidingly contacting surfaces of the cam slipper 25 and the low-speed cam 21. Therefore, irregular loads are prevented from acting on the slidingly contacting surfaces of the cam slipper 25 and the low-speed cam 21.

Figure 6:
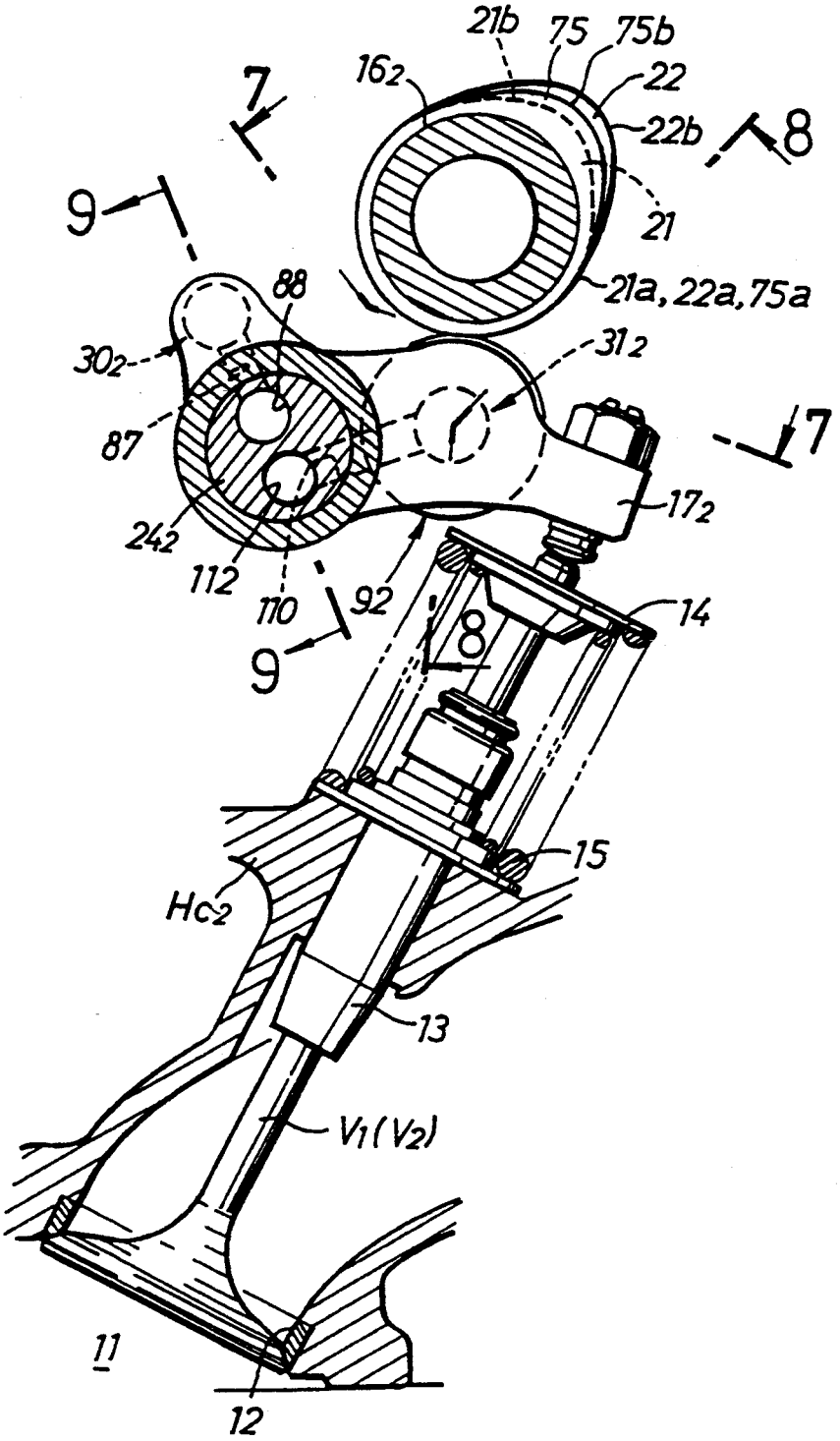
FIG. 6 is a longitudinal sectional view, taken along a line 6—6 in FIG. 7, of a second embodiment of the invention when being applied to an intake valve-side valve operating device in an SOHC internal combustion engine.
Figure 7:
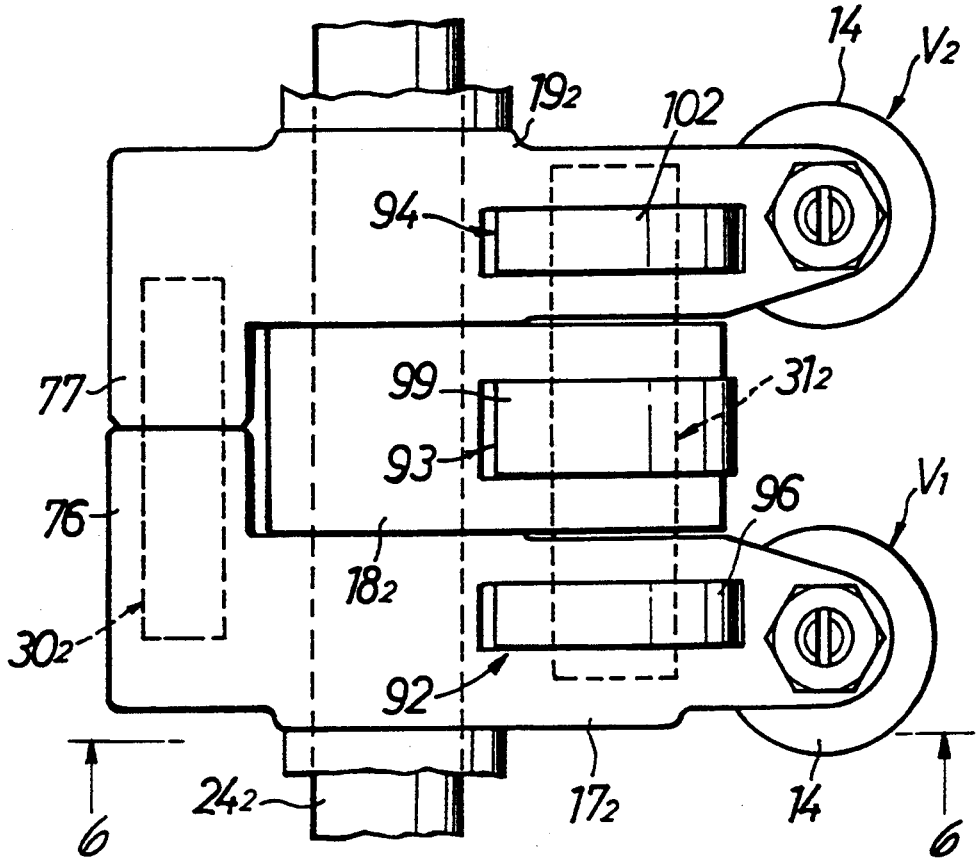
FIG. 7 is an enlarged plan view taken along a line 7—7 in FIG. 6.

FIGS. 6 to 9 show a second embodiment of the invention. As shown in FIGS. 6 and 7, first, second, and third rocker arms $17_2$, $18_2$, $19_2$ are interposed between a pair of intake valves $V_1$, $V_2$ openably and closably supported by a cylinder head Hc2 of a DOHC internal combustion engine and a cam shaft $16_2$ for converting rotary movement of the cam shaft $16_2$ to opening and closing movement of the intake valves $V_1$, $V_2$.

Figure 8:
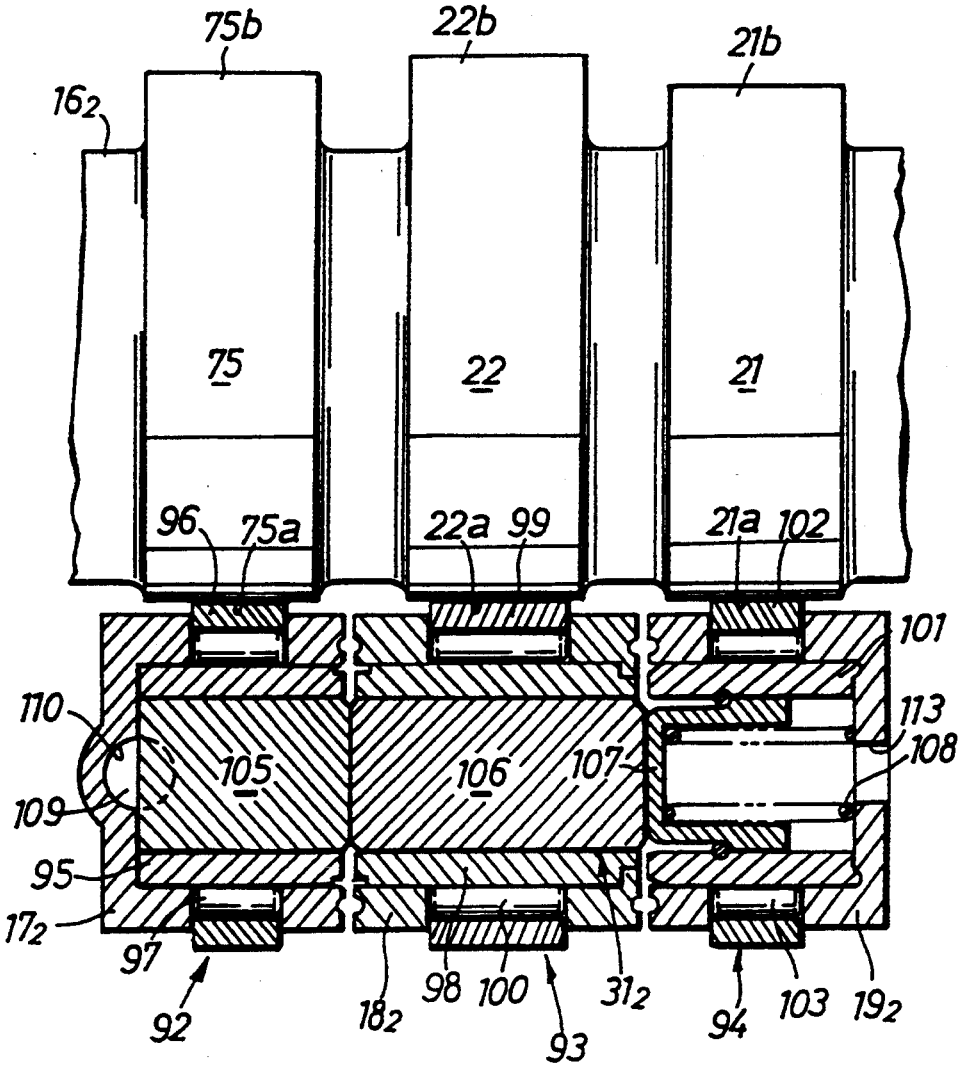
FIG. 8 is an enlarged sectional view taken along a line 8—8 in FIG. 6.

As also shown in FIG. 8, the cam shaft $16_2$ has a medium-speed cam 75, a high-speed cam 22, and a low-speed cam 21 which are integrally formed with the cam shaft $16_2$ and successively arranged in the order named. The medium-speed cam 75 has a cam profile for opening and closing the intake valve $V_1$ in a low-speed operating range of the engine and opening and closing the intake valves $V_1$, $V_2$ in a medium-speed operating range of the engine. The medium-speed cam 75 comprises a base-circle portion **75*a* and a cam lobe 75*b* projecting radially outwardly from the base-circle portion 75*a*. The cam lobe 75*b* projects more radially outwardly than the cam lobe 21*b* of the low-speed cam 21 and less radially outwardly than the cam lobe 22*b* of the high-speed cam 22 and has a larger angular extent than the cam lobe 21*b* and a smaller angular extent than the cam lobe 22*b***.

The first rocker arm $17_2$ has one end operatively coupled to the intake valve $V_1$, and the third rocker arm $19_2$ has one end operatively coupled to the intake valve $V_2$. The second rocker arm $18_2$ is disposed between the first and third rocker arms $17_2$, $19_2$ adjacent thereto. The rocker arms $17_2$ to $19_2$ are rockably supported on a rocker arm shaft $24_2$ positioned obliquely downwardly of the cam shaft $16_2$ and having an axis parallel to the cam shaft $16_2$.

A first selective coupling means $30_2$ is disposed between the first and third rocker arms $17_2$, $19_2$ for selectively connecting and disconnecting the first and third rocker arms $17_2$, $19_2$. A second selective coupling means $31_2$ is disposed in the first to third rocker arms $17_2$ to $19_2$ at a position different from the first selective coupling means $30_2$ around the axis of the rocker arm shaft $24_2$ for selectively connecting and disconnecting the first to third rocker arms $17_2$ to $19_2$ independently of the first selective coupling means $30_2$.

Figure 9:
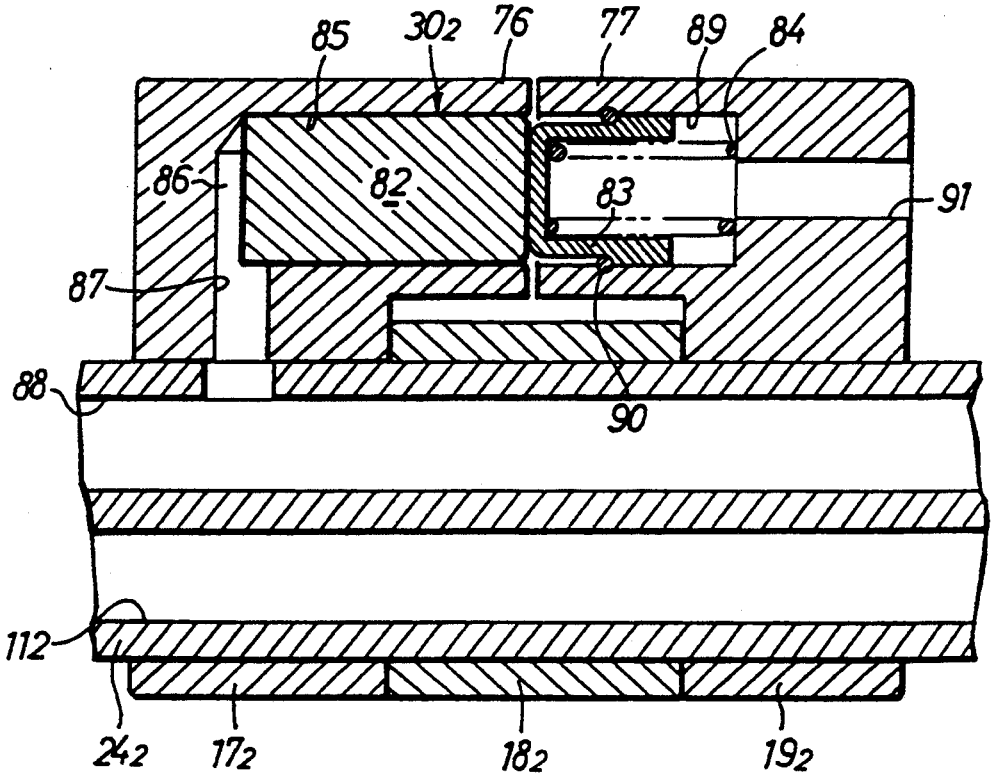
FIG. 9 is an enlarged sectional view taken along a line 9—9 in FIG. 6.

As also shown in FIG. 9, the first and third rocker arms $17_2$, $19_2$ have respective integral joint arms 76, 77 positioned remotely from the intake valves $V_1$, $V_2$ across the rocker arm shaft $24_2$ and extending across the second rocker arm $18_2$ in confronting relationship to each other. The first selective coupling means $30_2$ is disposed between the joint arms 76, 77. The second selective coupling means $31_2$ is located in the first to third rocker arms $17_2$ to $19_2$ between the position in which the first and third rocker arms $17_2$, $19_2$ are operatively coupled to the intake valves $V_1$, $V_2$ and the rocker arm shaft $24_2$.

The first selective coupling means $30_2$ comprises a coupling piston 82 capable of connecting the joint arms 76, 77, a limiting member 83 for limiting movement of the coupling piston 82, and a return spring 84 for urging the coupling piston 82 and the limiting member 83 in a direction to disconnect the joint arms 76, 77 from each other.

The joint arm 76 of the first rocker arm $17_2$ and the joint arm 77 of the third rocker arm $19_2$ have respective guide holes 85, 89 defined therein parallel to the rocker arm shaft $24_2$.

The coupling piston 82 is slidably fitted in the guide hole 85, with a hydraulic pressure chamber 86 being defined between the coupling piston 82 and the closed end of the guide hole 85. The first rocker arm $17_2$ has a communication passage 87 communicating with the hydraulic pressure chamber 86. The rocker arm shaft $24_2$ has a hydraulic pressure passage 88 communicated to a hydraulic pressure supply source (not shown). The hydraulic pressure passage 88 is always communicated with the communication passage 87 and hence the hydraulic pressure chamber 86 irrespective of how the first rocker arm $17_2$ is angularly moved.

The limiting member 83, which is in the form of a bottomed hollow cylinder, is slidably fitted in the guide hole 89 and prevented from being dislodged out of the guide hole 89 by a retaining ring 90 fitted in an inner surface of the guide hole 89. The return spring 84 is disposed under compression between the closed end of the guide hole 89 and the limiting member 83. The closed end of the guide hole 89 has a communication hole 91 for bleeding air and oil.

The first to third rocker arms $17_2$ to $19_2$ move in response to the respective cams 75, 22, 21 through respective roller followers 92, 93, 94. These roller followers are mounted on the respective rocker arms $17_2$ to $19_2$ between the rocker arm shaft $24_2$ and the intake valves $V_1$, $V_2$. The second rocker arm $18_2$ is normally urged to hold the roller follower 92 in contact with the high-speed cam 22 by a resiliently urging means (not shown).

The roller follower 92 comprises an inner race 95 having an axis parallel to the rocker arm shaft $24_2$ and fixedly fitted over the first rocker arm $17_2$, an outer race 96 held in contact with the medium-speed cam 75, and a plurality of rollers 97 interposed between the inner and outer races 95, 96. The roller follower 93 comprises an inner race 98 having an axis parallel to the rocker arm shaft $24_2$ and fixedly fitted over the second rocker arm $18_2$, an outer race 99 held in contact with the high-speed cam 22, and a plurality of rollers 100 interposed between the inner and outer races 98, 99. The roller follower 94 comprises an inner race 101 having an axis parallel to the rocker arm shaft $24_2$ and fixedly fitted over the third rocker arm $19_2$, an outer race 102 held in contact with the low-speed cam 21, and a plurality of rollers 103 interposed between the inner and outer races 101, 102. The inner races 95, 98, 101 are fixedly fitted over the respective rocker arms $17_2$ to $19_2$ such that they are aligned with each other when the rocker arms $17_2$ to $19_2$ are at rest.

The second selective coupling means $31_2$ comprises a coupling piston 105 capable of connecting the first and second rocker arms $17_2$, $18_2$, a coupling pin 106 capable of connecting the second and third rocker arms $18_2$, $19_2$, a limiting member 107 for limiting movement of the coupling piston 105 and the coupling pin 106, and a return spring 108 for urging the coupling piston 105, the coupling pin 106, and the limiting member 107 to disconnect the rocker arms.

The coupling piston 105 is slidably fitted in the inner race 95 of the roller follower 92, with a hydraulic pressure chamber 109 defined between one end of the coupling piston 105 and the first rocker arm $17_2$. The first rocker arm $17_2$ has a communication passage 110 communicating with the hydraulic pressure chamber 109. The rocker arm shaft $24_2$ has a hydraulic pressure passage 112 communicated to a hydraulic pressure supply source(not shown) and isolated from the hydraulic passage 87 of the first selective coupling means $30_2$. The hydraulic pressure passage 112 is always communicated with the communication passage 110 and hence the hydraulic pressure chamber 109 irrespective of how the first rocker arm $17_2$ may be angularly moved.

The coupling pin 106 whose one end abuts against the other end of the coupling piston 105 is slidably fitted in the inner race 98 of the roller follower 93.

The limiting member 107, which is in the form of a bottomed hollow cylinder, abuts against the other end of the coupling pin 106 and is slidably fitted in the inner race 101 of the roller follower 94. The return spring 108 is compressed between the third rocker arm $19_2$ and the limiting member 107. The third rocker arm $19_2$ has a communication hole 113 coaxial with the inner race 101.

According to this second embodiment, in the low-speed operating range of the engine, the first and second selective coupling means $30_2$, $31_2$ are actuated to disconnect the joint arms and the rocker arms. The intake valve $V_1$ is opened and closed with timing and lift according to the cam profile of the medium-speed cam 75, and the other intake valve $V_2$ is opened and closed with timing and lift according to the cam profile of the low-speed cam 21. In the medium-speed operating range of the engine, the first selective coupling means $30_2$ connects the joint arms, and the second selective coupling means $31_2$ still disconnects the rocker arms. The intake valves $V_1$, $V_2$ are opened and closed with timing and lift according to the cam profile of the medium-speed cam 75. In the high-speed operating range of the engine, at least the second selective coupling means $31_2$ connects the rocker arms, and the intake valves $V_1$, $V_2$ are opened and closed with timing and lift according to the cam profile of the high-speed cam 22.

Therefore, depending on the operating conditions, i.e., the low-, medium-, and high-speed operating ranges, of the engine, the operating characteristics of the intake valves $V_1$, $V_2$ may be varied for reducing fuel consumption in the low-speed operating range and increasing the engine output power in all of the operating ranges of the engine. Furthermore, since the intake valve $V_2$ operatively coupled to the third rocker arm $19_2$ can be operatively coupled to the first rocker arm $17_2$ across the second rocker arm $18_2$, the intake valve $V_2$ is opened and closed by the low-speed cam 21 in the low-speed operating range of the engine, opened and closed by the medium-speed cam 75 in the medium-speed operating range of the engine, and opened and closed by the high-speed cam 22 in the high-speed operating range of the engine. The intake valve $V_2$ is therefore capable of varying its operating characteristics in three steps. This, together with the fact that the intake valve $V_1$ operatively coupled to the first rocker arm $17_2$ can vary its operating characteristics in two steps, i.e., is opened and closed by the medium-speed cam 75 and opened and closed by the high-speed cam 22, permit the operating characteristics of the intake valves $V_1$, $V_2$ which are variable depending on the operating conditions of the engine to be selected in combinations more freely than heretofore.

As the first and second selective coupling means $30_2$, $31_2$ are displaced from each other in the circumferential direction relative to the rocker arm shaft $24_2$, the axial length of the coupling piston 105, the coupling pin 106, and the limiting member 107 of the second selective coupling means $31_2$ may be set longer without increasing the width along the axis about which the rocker arms $17_2$ to $19_2$ swing than would be if a pair of selective coupling means for selectively connecting and disconnecting adjacent rocker arms were coaxially arranged. Therefore, without increasing the width of the rocker arms $17_2$ to $19_2$, the roller followers 92 to 94 may be positioned coaxially with the second selective coupling means $31_2$ for reducing the frictional resistance between the cams 75, 22, 21 and the rocker arms $17_2$ to $19_2$ for achieving a reduction in the power required to operate the valves.

Figure 10:
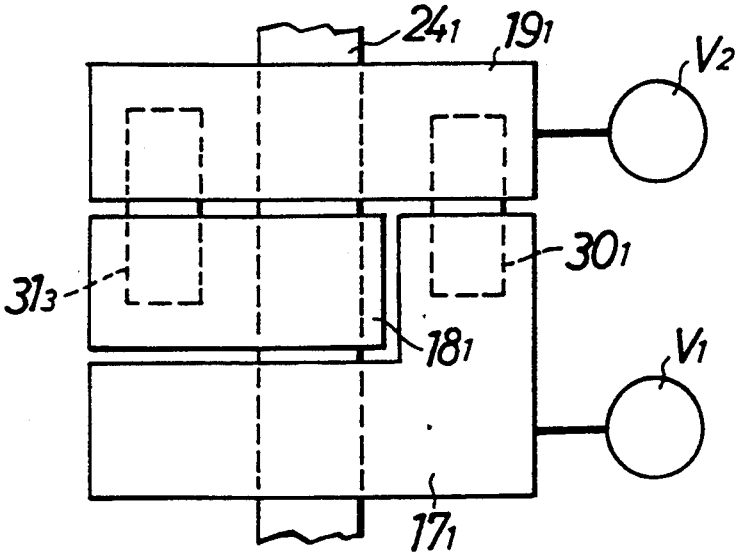
FIG. 10 is a simplified plan view of a third embodiment of the invention.

FIG. 10 shows a third embodiment of the present invention. An SOHC internal combustion engine has a first rocker arm $17_1$ operatively coupled to an intake valve $V_1$ and held in sliding contact with a low-speed cam, a third rocker arm $19_1$ operatively coupled to an intake valve $V_2$ and held in sliding contact with a raised portion for substantially disabling the intake valve $V_2$ and a second rocker arm $18_1$disposed between the first rocker arm $17_1$ and the third rocker arm $19_1$and held in sliding contact with a high-speed cam. A first selective coupling means $30_1$ is disposed between the first and third rocker arms $17_1$, $19_1$, and a second selective coupling means $31_3$ which is of basically the same structure as the first selective coupling means $30_2$ in the second embodiment is disposed between second and third rocker arms $18_1$, $19_1$.

In the low-speed operating range of the engine, the first and second selective coupling means $30_1$, $31_3$ disconnect the rocker arms to cause the intake valve $V_1$ to be actuated by the low-speed cam, and disable the other intake valve $V_2$. In the medium-speed operating range of the engine, only the first selective coupling means $30_1$ connects the rocker arms to cause the intake valves $V_1$, $V_2$ to be actuated by the low-speed cam. In the high-speed operating range of the engine, the first and second selective coupling means $30_1$, $31_3$ connect all three of the rocker arms to cause the intake valves $V_1$, $V_2$ to be actuated by the high-speed cam.

Figure 11:
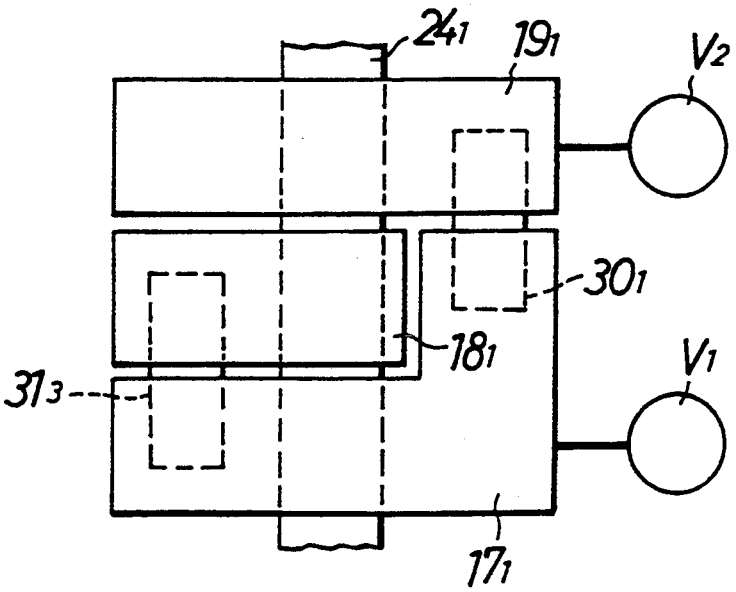
FIG. 11 is a simplified plan view of a fourth embodiment of the invention.

FIG. 11 shows a fourth embodiment of the invention. An SOHC internal combustion engine has a first rocker arm $17_1$ operatively coupled to an intake valve $V_1$ and held in sliding contact with a low-speed cam, a third rocker am $19_1$ operatively coupled to an intake valve $V_2$ and held in sliding contact with a raised portion for substantially disabling the intake valve $V_2$, and a second rocker arm $18_1$ disposed between the first rocker arm $17_1$ and the third rocker arm $19_1$ and held in sliding contact with a high-speed cam. A first selective coupling means $30_1$ is disposed between the first and third rocker arms $17_1$, $19_1$, and a second selective coupling means $31_3$ is disposed between the first and second rocker arms $17_1$, $18_1$.

In the low-speed operating range of the engine, the first and second selective coupling means $30_1$, $31_3$ disconnect the rocker arms to cause the intake valve $V_1$ to be actuated by the low-speed cam, and disable the other intake valve $V_2$. In the medium-speed operating range of the engine, only the first selective coupling means $30_1$ connects the rocker arms to cause the intake valves $V_1$, $V_2$ to be actuated by the low-speed cam. In the high-speed operating range of the engine, the first and second selective coupling means $30_1$, $31_3$ connect all the rocker arms to cause the intake valves $V_1$, $V_2$ to be actuated by the high-speed cam.

Figure 12:
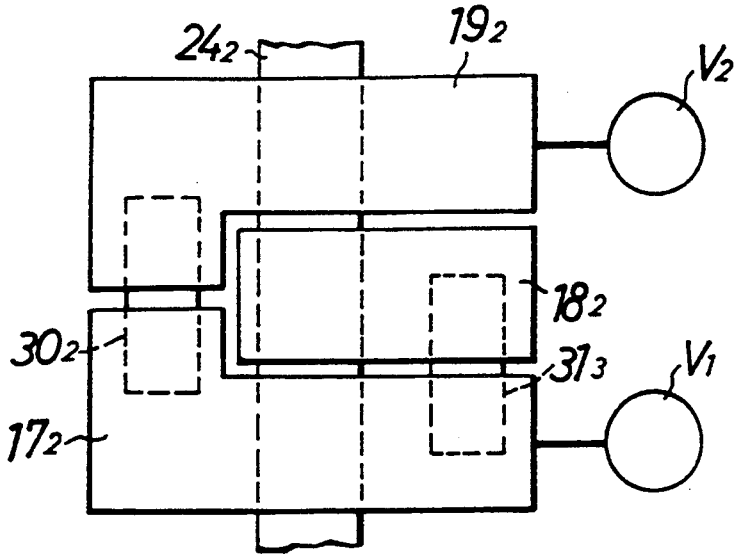
FIG. 12 is a simplified plan view of a fifth embodiment of the invention.

FIG. 12 shows a fifth embodiment of the invention. A DOHC internal combustion engine has a first rocker arm $17_2$ operatively coupled to an intake valve $V_1$ and held in sliding contact with a medium-speed cam, a third rocker arm $19_2$ operatively coupled to an intake valve $V_2$ and held in sliding contact with a low-speed cam, and a second rocker arm $18_2$ disposed between the first rocker arm $17_2$ and the third rocker arm $19_2$ and held in sliding contact with a high-speed cam. A first selective coupling means $30_2$ is disposed between the first and third rocker arms $17_2$, $19_2$, and a second selective coupling means $31_3$, is disposed between the first and second rocker arms $17_2$, $18_2$.

According to the fifth embodiment, in the low-speed operating range of the engine, the first and second selective coupling means $30_1$, $31_3$ disconnect the rocker arms to cause the intake valve $V_1$ to be actuated by the medium-speed cam, and also to cause the intake valve $V_2$ to be actuated by the low-speed cam. In the medium-speed operating range of the engine, only the first selective coupling means $30_2$ connects the rocker arms to cause the intake valves $V_1$, $V_2$ to be actuated by the medium-speed cam. In the high-speed operating range of the engine, the first and second selective coupling means $30_2$, $31_3$ connect the rocker arms to cause the intake valves $V_1$, $V_2$ to be actuated by the high-speed cam.

Figure 13:
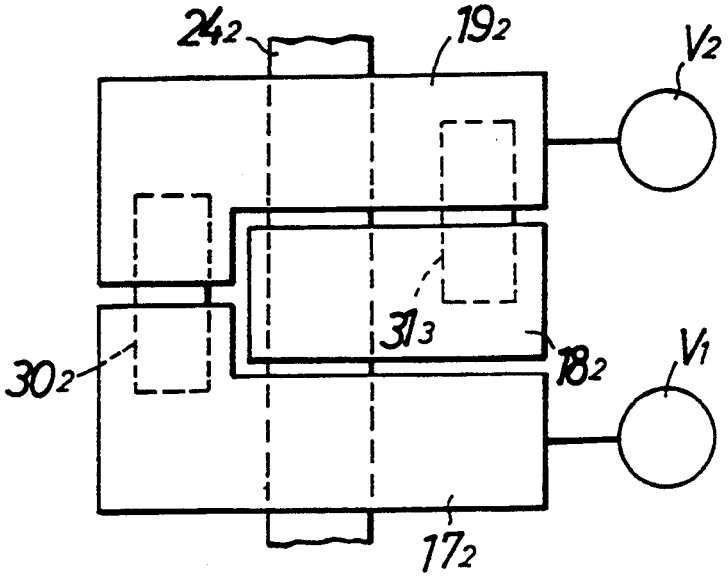
FIG. 13 is a simplified plan view of a sixth embodiment of the invention.

FIG. 13 shows a sixth embodiment of the invention. A DOHC internal combustion engine has a first rocker am $17_2$ operatively coupled to an intake valve $V_1$ and held in sliding contact with a medium-speed cam, a third rocker am $19_2$ operatively coupled to an intake valve $V_2$ and held in sliding contact with a low-speed cam, a first selective coupling means $30_2$ disposed between the first rocker arm $17_2$ and the third rocker arm $19_2$, a second rocker arm $18_2$ disposed between the first rocker arm $17_2$ and the third rocker arm $19_2$ and held in sliding contact with a high-speed cam, and a second selective coupling means $31_3$ disposed between the second and third rocker arms $18_2$, $19_2$.

Figure 14:
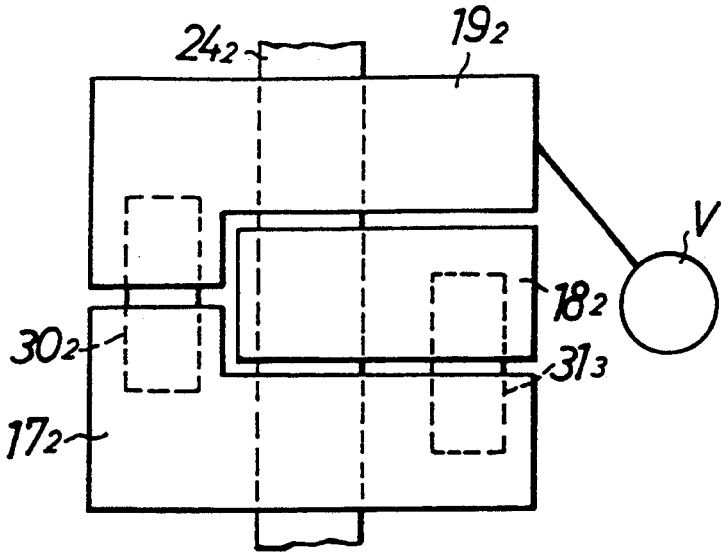
FIG. 14 is a simplified plan view of a seventh embodiment of the invention.

FIG. 14 shows a seventh embodiment. In this embodiment, a DOHC internal combustion engine has a single intake valve V operatively coupled to a third rocker arm $19_2$ in a position corresponding to a second rocker arm $18_2$ held in sliding contact with a high-speed cam, a first selective coupling means $30_2$ disposed between a first rocker arm $17_2$ and the third rocker arm $19_2$, and a second selective coupling means $31_3$ disposed between the first and second rocker arms $17_2$, $18_2$.

According to the seventh embodiment, in the low-speed operating range of the engine, the first and second selective coupling means $30_2$, $31_3$ disconnect the rocker arms to cause the intake valve V to be actuated by the low-speed cam engaged by third rocker arm $19_2$. In the medium-speed operating range of the engine, only the first selective coupling means $30_2$ connects the rocker arms to cause the intake valve V to be actuated by the medium-speed cam engaged by first rocker arm $17_2$. In the high-speed operating range of the engine, the first and second selective coupling means $30_2$, $31_3$ connect all the rocker arms to cause the intake valve V to be actuated by the high-speed cam engaged by the second rocker arm $18_2$. The third rocker arm $19_2$ operatively coupled to the intake valve V is positioned adjacent to the second rocker arm $18_2$ that is angularly moved by the high-speed cam. Therefore, in the high-speed operating range of the engine, the point where the load is applied from the high-speed cam to the second rocker arm $18_2$ and the point where the load is applied therefrom to the valve V may be located closely to each other, as shown in FIG. 14, for minimizing the generation of irregular loads.

Figure 15:
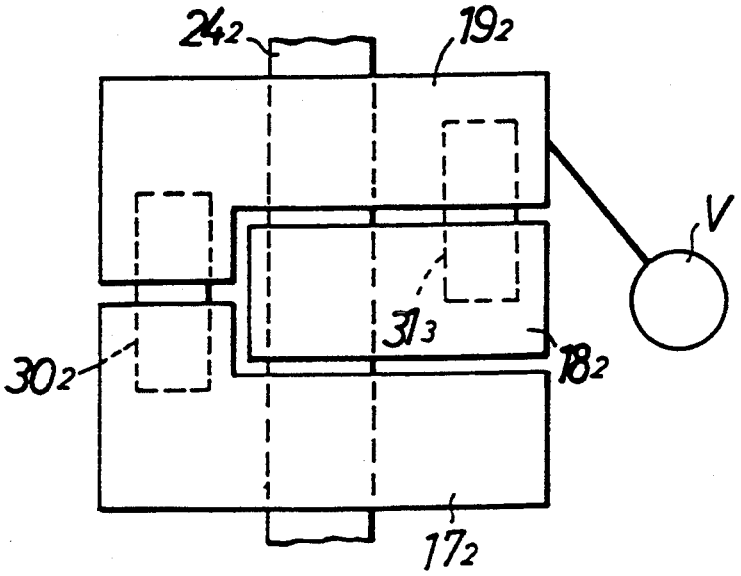
FIG. 15 is a simplified plan view of a eighth embodiment of the invention.

FIG. 15 shows an eighth embodiment of the invention. A first selective coupling means $30_2$ is disposed between a first rocker arm $17_2$ held in sliding contact with a medium-speed cam and a third rocker arm $19_2$ operatively coupled to an intake valve V and held in sliding contact with a low-speed cam, and a second selective coupling means $31_3$ is disposed between a second rocker arm $18_2$ held in sliding contact with a high-speed cam and the third rocker arm $19_2$ and is disposed between the first and third rocker arms $17_2$, $19_2$.

Figure 16:
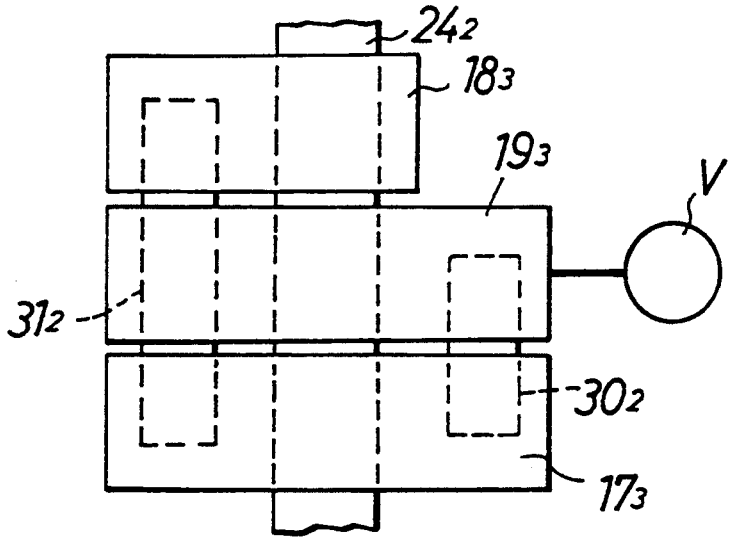
FIG. 16 is a simplified plan view of a ninth embodiment of the invention.

FIG. 16 shows a ninth embodiment. In this embodiment, a first rocker arm $17_3$ slidably contacted by the medium-speed cam and operatively coupled to the intake valve V, as well as a second rocker arm $18_3$ slidably contacted by the high-speed cam are disposed at opposite sides of a third rocker arm $19_3$ which is operatively coupled to the intake valve V and is slidably contacted by the low-speed cam. The first selective coupling means $30_2$ which is capable of connecting and disconnecting the first and third rocker arms $17_3$, $19_3$, and the second selective coupling means $31_2$ which is capable of connecting and disconnecting the first, second and third rocker arms $17_3$ to $19_3$ are disposed at locations displaced circumferentially relative to the rocker arm shaft $24_2$.

According to the ninth embodiment, in the low-speed operating range of the engine, the first and second selective coupling means $30_2$, $31_2$ disconnect the rocker arms to cause the intake valve V to be opened and closed by the low-speed cam. In the medium-speed operating range of the engine, the first selective coupling means $30_2$ connects the rocker arms to cause the intake valve V to be opened and closed by the medium-speed cam. In the high-speed operating range of the engine, the second selective coupling means $31_2$ connects the rocker arms to cause the intake valve to be opened and closed by the high-speed cam.

Figure 17:
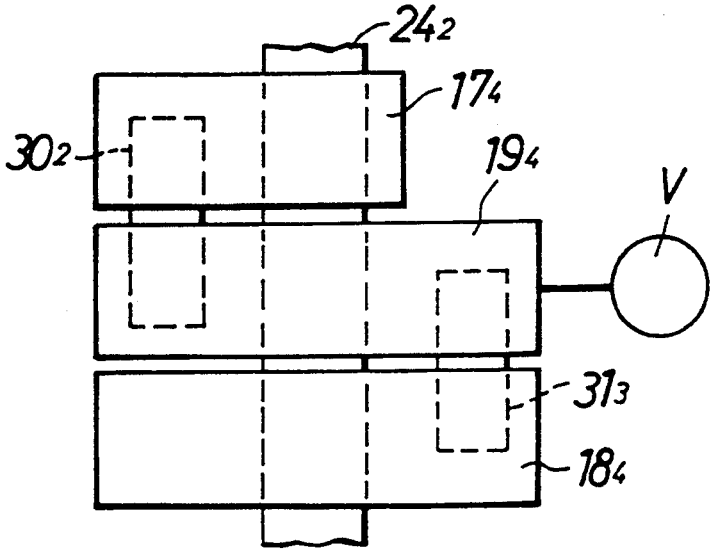
FIG. 17 is a simplified plan view of a tenth embodiment of the invention.

FIG. 17 shows a tenth embodiment. As in the preceding embodiment, the first selective coupling means $30_2$ which connects and disconnects a third rocker arm $19_4$ slidably contacted with the low-speed cam and a first rocker arm $17_4$ slidably contacted with the medium-speed cam, and the second selective coupling means $31_3$ which connects and disconnects the third rocker arm $19_4$ slidably contacted with the high-speed cam and the third rocker arm $19_4$ may be disposed at locations displaced circumferentially relative to the rocker arm shaft $24_2$.

Although various embodiments of the invention have been described in detail, the invention should not be limited to the above embodiments, but various design modifications may be made without departing the invention as defined by the scope of claims. For example, the present invention is also applicable to a valve operating device for operating exhaust valves.

What is claimed is:

1. A valve operating device for an internal combustion engine for varying operating characteristics of an engine valve depending upon operating conditions of the engine, comprising:

a first rocker arm movable in response to a first cam, a second rocker arm movable in response to a second cam corresponding to a higher speed operating condition than that of said first cam, a third rocker arm operatively connected to an engine valve, said first, second and third rocker arms being pivotally supported on a rocker arm shaft, first selective coupling means capable of switching the connection and disconnection between said third and first rocker arms, and second selective coupling means capable of switching the connection and disconnection between said second rocker arm and at least one of the first and third rocker arms independently of said first selective coupling means, the first and second, selective coupling means being located at substantially the same radial distance from and close to the rocker arm shaft and disposed at locations displaced circumferentially relative to the rocker arm shaft for avoiding mutual interference between the first and second selective coupling means.

2. A valve operating device for an internal combustion engine according to claim 1, wherein at least one of the first and second selective coupling means includes a connection piston which exhibits a spring force in an expanding direction thereof for expanding and contracting, and which said connection piston is operable in a direction parallel to an axis of the rocker arm shaft; and wherein said device further includes a trigger which is disposed for angular displacement relative to the rocker arms and is brought into detachable engagement with the connecting piston for restraining the operational timing.

3. A valve operating device for an internal combustion engine according to claim 1, further including a third cam provided to be engaged by said third rocker arm, and roller followers provided on said first, second and third rocker arms to come into contact with said first, second and third cams, respectively; and wherein either one of said first and second selective coupling means is disposed coaxially with said roller followers.

4. A valve operating device for an internal combustion engine according to claim 1 and further comprising;

said second rocker arm pivotally supported between said first and third rocker arms, said first selective coupling means mounted astride said second rocker arm for switching the connection and disconnection between said third rocker arm and said first rocker arm, and second selective coupling means mounted between at least two mutually adjacent ones of first through third rocker arms for switching the connection and disconnection between said adjacent rocker arms independently of said first selective coupling means.

5. A valve operating device for an internal combustion engine according to claim 4, wherein an engine valve other than the engine valve operatively connected to the third rocker arm is operatively connected to said first rocker arm.

6. A valve operating device for an internal combustion engine for varying operating characteristics of an engine valve depending on operating conditions of the engine, comprising:

three rocker arms pivotally supported on a rocker shaft in adjacent relationship, at least one of said rocker arms operatively engaging an engine valve, at least two of said rocker arms engaging two separate cams having different valve lift cam lobes, and two separate selectively operable coupling means for selectively coupling and uncoupling at least one of said rocker arms operatively engaging an engine valve to at least one of the other two rocker arms wherein said two separate coupling means are located at substantially the same radial distance from and close to said rocker shaft and wherein said two separate coupling means are circumferentially spaced from each other relative to said rocker shaft for avoiding mutual interference between said two separate coupling means.

7. The valve operating device of claim 6, wherein said two separate coupling means are selectively operated by two separate hydraulic pressure supply passages provided in said rocker shaft.

8. The valve operating device of claim 6, wherein two of said rocker arms separately engage two of said engine valves.

9. The valve operating device of claim 8, wherein said two rocker arms separately engaging engine valves separately engage two cams.

10. The valve operating device of claim 8, wherein one of said two rocker arms separately engaging engine valves engages a raised portion on a cam shaft having a small portion for briefly opening said valve for avoiding sticking.

11. The valve operating device of claim 6, wherein one of said two coupling means includes means for coupling all three rocker arms.

12. The valve operating device of claim 6, wherein one of said cams has a valve lift for high speed operation and is located adjacent the rocker arm located in the middle of the three rocker arms.

13. The valve operating device of claim 8, wherein said two rocker arms separately engaging two of said engine valves are located on said rocker shaft on opposite sides of the third rocker arm.

14. The valve operating device of claim 8, wherein said selective operation of said two of said coupling means causes one said engine valve to operate in two different lift modes and the other said engine valve to operate in three different lift modes dependent on the operating conditions of the engine.

* * * * *